United States Patent [19]

Gann

[11] Patent Number: 4,626,193

[45] Date of Patent: Dec. 2, 1986

[54] DIRECT SPARK IGNITION SYSTEM

[75] Inventor: Ronald A. Gann, La Crescenta, Calif.

[73] Assignee: ITT Corporation, New York, N.Y.

[21] Appl. No.: 761,644

[22] Filed: Aug. 2, 1985

[51] Int. Cl.[4] ..... F23N 5/00

[52] U.S. Cl. ..... 431/71; 340/579

[58] Field of Search ..... 431/25, 69, 71; 340/579; 320/1

[56] References Cited

U.S. PATENT DOCUMENTS 4,145,180 3/1979 Bendorf ..... 431/71

*Primary Examiner*—Samuel Scott
*Assistant Examiner*—Noah Kamen
*Attorney, Agent, or Firm*—T. L. Peterson; J. S. Christopher

[57] ABSTRACT

A direct spark ignition system is provided with an improved spark generator powered directly from a low voltage dc source through an inverter controlled by a gated oscillator. The inverter is comprised of a step-up transformer having its primary winding connected between the power source and a common-emitter transistor having its base electrode connected to an output of the oscillator. A rectifier couples the secondary winding to a storage capacitor, and a spark discharge timing means controls periodic discharge of the storage capacitor into a spark electrode. A diode between the collector of the switching transistor and the storage capacitor is poled to couple back EMF of the transformer primary winding into the capacitor, thereby not only protecting the collector of the transistor but adding the back EMF energy to the charge in the capacitor for higher efficiency. High spark rates (nominal 750 sparks per minute) are achieved.

2 Claims, 2 Drawing Figures

DIRECT SPARK IGNITION SYSTEM

BACKGROUND OF THE INVENTION

1. Field of the Invention

This invention relates to a gas fuel ignition system of the low voltage dc type disclosed in U.S. Pat. No. 4,019,854 utilizing a gated oscillator, and more particularly to an improved spark generating circuit.

2. Description of the Prior Art

There is a need for low voltage dc ignition systems, such as for igniting gas fuel burners in motor homes or other recreational vehicles having only 12 V dc power available. In the prior art system disclosed in the aforesaid patent, a trial ignition is initiated upon closing a switch that applies the 12 V dc power to an ignition system that includes a gated oscillator which powers the spark generator, and opens a fuel valve. If ignition is successfully achieved, spark generation is suppressed due to the lower impedance at the spark electrode in the presence of a flame. However, operation of the oscillator is sustained by a flame sensor in order to keep the fuel valve open.

SUMMARY OF THE INVENTION

An object of this invention is to provide an improved circuit for charging a storage capacitor for a spark generator of higher frequency (nominal 750 versus 150 sparks per minute) and equivalent energy as compared to prior art spark generators.

In accordance with the invention, a low voltage applied to the ignition system initiates a trial ignition by gating on an oscillator that opens the fuel valve, but instead of powering the spark generator from the oscillator, the low voltage is converted to a higher voltage by a switching converter that is driven by the oscillator. The output of the converter (comprised of a dc-to-ac inverter and rectifying diode) is connected to a storage capacitor. The inverter is comprised of a step-up transformer having in series with the primary winding a common emitter transistor switch that is alternately turned on and off. A diode connected between the collector of said transistor and the storage capacitor couples the inductive "kick-back" (back EMF) of the primary winding to the capacitor when the transistor switch is turned off, and adds it to the charge in the storage capacitor to improve efficiency.

The novel features that are considered characteristic of this invention are set forth with particularity in the appended claims. The invention will best be understood from the following description when read in connection with the accompanying drawings.

DESCRIPTION OF THE PREFERRED EMBODIMENT

Figure 1:
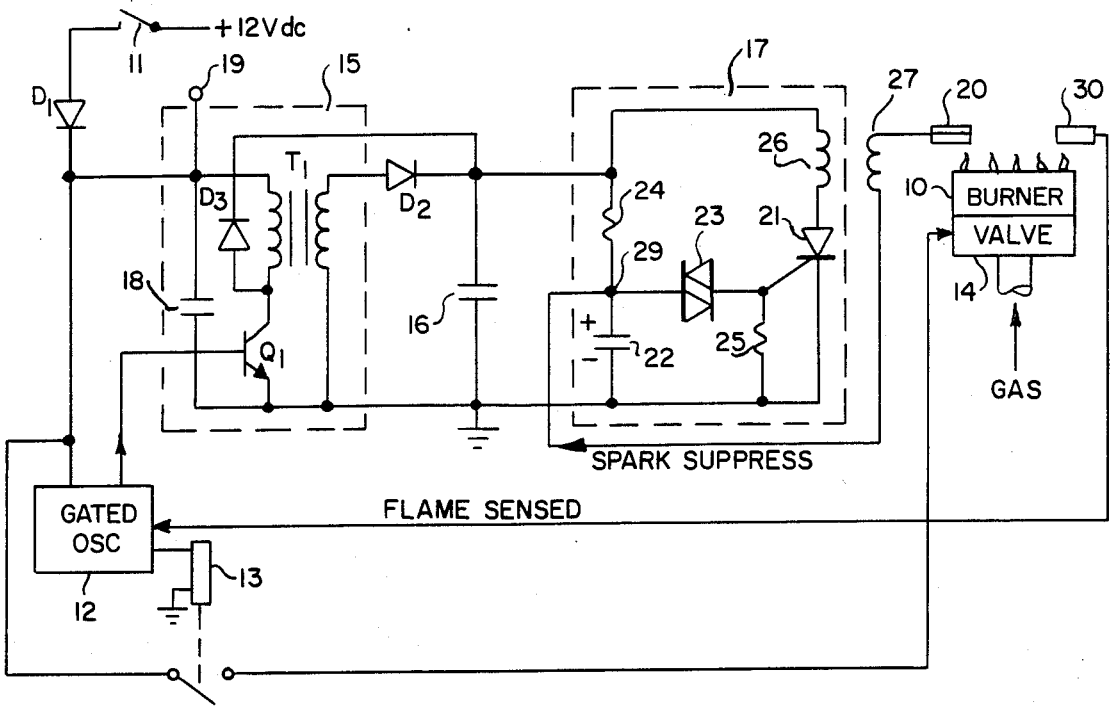
FIG. 1 is a diagram of an ignition system embodying the present invention.

Referring to FIG. 1, ignition of a burner 10 takes place when a switch 11 is closed manually, or by a thermostat or other means. Closing the switch 11 applies +12 V dc to a gated oscillator 12 which is then gated on for a trial period set by an RC timing circuit contained therein, as will be described with reference to FIG. 2. The output of the oscillator 12 energizes a relay 13 to open a fuel valve 14. The output of the oscillator 12 is also connected to a spark generator which is comprised of an inverter section 15, a storage capacitor 16 and a spark timing circuit 17.

The output of the oscillator 12 is connected to the base of a transistor $Q_1$ that is in series with the primary winding of a transformer $T_1$ coupled to the dc power supply by a diode $D_1$. The transistor $Q_1$ acts as a chopper to convert the dc power supply to an ac voltage that is stepped up by the transformer $T_1$ to a high voltage. That high voltage is then rectified by a diode $D_2$ and stored in the capacitor 16. A diode $D_3$ connected between the capacitor 16 and the end of the primary winding opposite its dc input takes the inductive "kick-back" (back EMF) from the collector of the transistor and adds it to the storage capacitor 16, thus not only protecting the transistor $Q_1$ from high voltage when $Q_1$ is turned off, but also improving efficiency of the circuit functioning as an inverter 15. A capacitor 18 connected in parallel with the series combination of the primary winding of transformer $T_1$ and transistor $Q_1$ functions as a filter for the dc voltage at a terminal 19 from which dc bias voltage is provided to the gated oscillator 12.

A spark is generated at an electrode 20 when a silicon controlled rectifier (SCR) 21 or other thyristor (triggered discharge device) is fired by an RC timing circuit comprised of a capacitor 22, a threshold device 23 (shown schematically as two opposed diodes in a device commercially available and known as a diac, but which could be a gas diode) and two resistors 24 and 25. The capacitor 22 charges through the resistor 24 until it reaches the threshold level of the device 23, which then fires to discharge the capacitor 22 through resistor 25. The threshold device 23 will conduct until the capacitor has discharged to near zero, much like a neon diode. The positive voltage on the gate of the SCR 21 triggers that device which functions much like a thyratron to conduct heavily through a primary winding 26 of an ignition coil until the storage capacitor 16 has discharged to near zero. The secondary winding 27 of the ignition coil is connected between the spark electrode 20 and a junction 29.

In operation, the capacitor 22 charges to +60 V and triggers the SCR 21. Resistor 25 is much smaller than resistor 24 so that the capacitor 22 is discharged to very near zero volts during the application of a spark pulse to the electrode 20. When the SCR 21 extinguishes at the end of a spark pulse, the capacitor 22 recharges through the resistor 24 at a predetermined rate. This sets the spark rate, which is a nominal rate of 750 sparks per minute versus 150 sparks per minute in the circuit of the prior art U.S. Pat. No. 4,019,854. Notwithstanding the much higher spark rate, the spark obtained is of equivalent energy.

Once the fuel from the burner 10 ignites, the discharge path between the electrode 20 and the burner 10 lowers the resistance sufficiently to prevent the capacitor 22 from recharging to threshold level of the device 23. This spark suppression feature provided by connecting the secondary winding 27 of the ignition coil between the spark electrode 20 and the junction 29 is the same as in the spark generator of the aforesaid prior patent. The flame is sensed by a rod 30 which provides a continuous signal to the oscillator 12 shown in FIG. 2 for the purpose of maintaining it gated on. If the trial ignition fails during a predetermined period, the gated oscillator 12 will stop oscillating and the relay 13 will be deenergized to cause the burner valve 14 to close, thus shutting the fuel supply off. Also the chopping transistor $Q_1$ of the inverter will no longer be switched on, thus shutting down the spark timing circuit 17 until the switch 11 is opened and again closed.

The gated oscillator 12 will now be briefly described with reference to FIG. 2. In organization and operation, the circuit is very similar to that shown in the aforesaid prior art patent. The dc voltage at terminal 19 of the spark generator is applied to terminals also identified in FIG. 2 by the reference numeral 19 to provide positive bias voltage for the oscillator 12. Thus, when the switch 11 is closed, capacitors 33 and 34 begin to charge. When capacitor 34 charges sufficiently, an SCR 35 fires, thus connecting junction 36 to ground. This places a negative bias voltage on the base of a transistor $Q_2$ which is provided with transistor $Q_3$ as a Darlington pair. The Darlington pair are then turned on and they in turn provide a feedback path to gate the oscillator 12 on. Feedback for oscillation is provided by a capacitor 37 from a tap on the primary winding of an output transformer $T_2$ to the base of transistor $Q_2$. The gated oscillator 12 will continue to oscillate until the capacitor 33 discharges. The trial ignition period is thus set by the RC time constant of the capacitor 33 and resistors 38 and 39. When a flame is sensed a signal from the rod 30 will charge a capacitor 40 with the polarity shown to provide a continuous negative bias voltage through resistor 41, thus maintaining oscillation of the gated oscillator 12, which in turn continues to energize the relay 13 and operate the inverter 15. The spark timing circuit 17 will not, however, continue to operate owing to spark suppression connection from the ignition coil secondary winding 27 to the junction 29.

Figure 2:
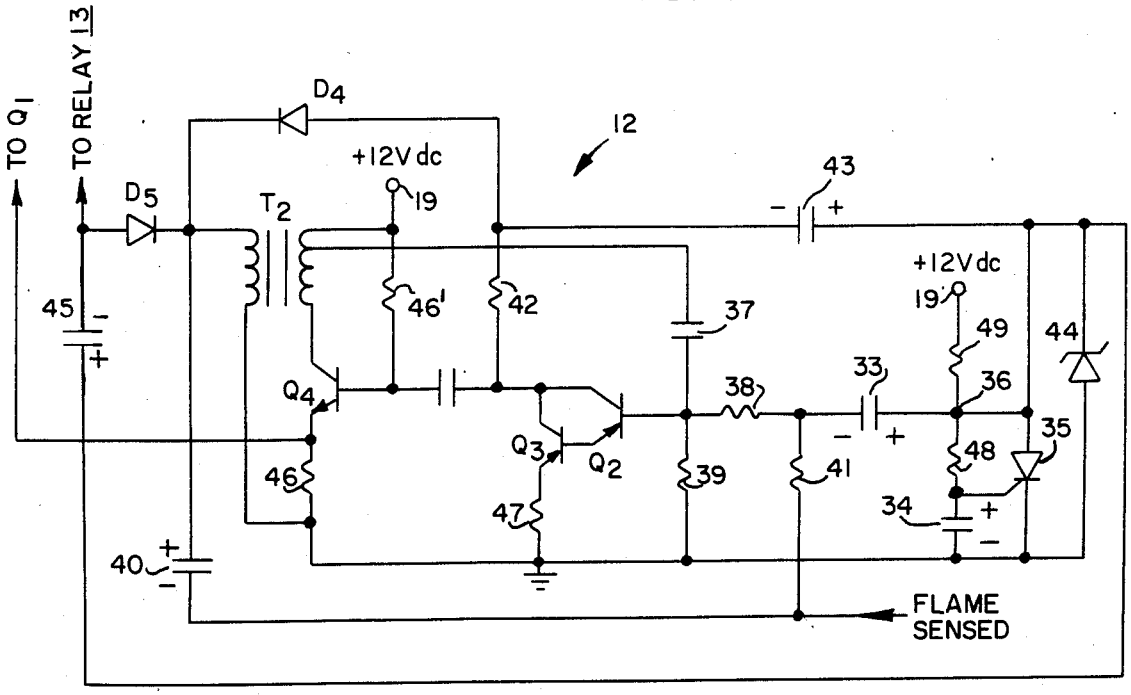
FIG. 2 is a circuit diagram of a gated oscillator shown in FIG. 1 as a functional block.

Other components shown in FIG. 2 are conventional. A diode $D_4$ rectifies the output of the transformer $T_2$ to provide a negative bias voltage to a load resistor 42 of the Darlington pair. A capacitor 43 filters that negative bias voltage. A Zener diode 44 between the capacitor 43 and circuit ground provides +8.4 V regulation for the SCR. Another diode $D_5$ rectifies the output of the transformer $T_2$ to provide a negative voltage to the relay 13 (FIG. 1). A capacitor 45 filters the rectified voltage of the diode $D_5$. An emitter resistor 46 provides bias and functions as a load resistor for the transistor $Q_4$ to obtain an emitter-follower output signal that drives the switching transistor $Q_1$ (FIG. 1). Resistor 46 and a resistor 47 are bias resistors for transistors $Q_4$ and $Q_3$, respectively. A pair of resistors 48 and 49 control the rate at which capacitor 34 charges for RC timing of the trigger for the SCR 35. Once the SCR 35 fires, the RC timing of the capacitor 33 and its discharge path (through resistor 38, the base emitter junctions of the Darlington pair $Q_2$ and $Q_3$ and resistor 47 in parallel with the resistor 39) will control the duration of the trial ignition. If a flame is not sensed, the system shuts down when the capacitor 33 has discharged sufficiently. But if a flame is sensed, a signal through resistor 41 will keep the oscillator gated on.

Although particular embodiments of the invention have been described and illustrated herein, it is recognized that modifications and variations may readily occur to those skilled in the art. Consequently, it is intended that the claims be interpreted to cover such modifications and variations.

What is claimed is:

1. In a low voltage direct spark ignition system having a gated oscillator for opening a fuel valve and initiating a trial ignition by a spark electrode, and a flame sensor for sustaining said oscillator operation after trial ignition, thereby to hold said valve open while flame is sensed, an improved spark generator comprised of an inverter having an input and output terminal, and a control terminal connected to said oscillator, said inverter being responsive to said oscillator for converting low dc power supply voltage at its input terminal to high ac voltage at its output terminal, a storage capacitor a rectifier connecting said inverter output terminal to said storage capacitor, and a spark timing means for periodically discharging said storage capacitor into said spark electrode at a predetermined rate, an improvement wherein said inverter is comprised of a step-up transformer having in series with the primary winding a switch that is alternately turned on and off, and a diode connected between said switch and said storage capacitor for coupling the back EMF of said primary winding to said capacitor when said switch is turned off, thereby to protect said switch from back EMF voltage and also improve efficiency.

2. In a direct spark ignition system having a gas burner, an electrically operable valve connected to said burner to admit fuel thereto, a gated oscillator having a timing circuit for timing a trial ignition, a spark generator responsive to said oscillator for igniting fuel emanating from said burner, and a flame sensor for sustaining oscillations of said oscillator while a flame exists at said burner, said spark generator having an inverter connected to a low voltage dc source and responsive to said oscillator for converting said dc voltage to a high ac voltage, a means for rectifying said high ac voltage, a capacitor connected to said rectifying means for storing said rectified high voltage, an ignition coil in series between said storage capacitor and a switch, and a means for periodically turning on said switch to produce ignition pulses through said coil, whereby said ignition system is powered from said dc source but controlled by said oscillator, an improvement wherein said inverter is comprised of a step-up transformer having its primary winding connected in series with said dc source and a common emitter transistor having its collector connected to said primary winding, said transistor having its base connected to be controlled by said oscillator to chop the dc into ac in the primary winding, and a diode connected between said storage capacitor and said collector of said transistor, said diode being poled to couple into said capacitor back EMF energy when said transistor is turned off.

* * * * *